United States Patent [19]

Tsuji

[11] Patent Number: 4,600,087

[45] Date of Patent: Jul. 15, 1986

[54] APPARATUS FOR REGISTERING ELEVATOR CALL

[75] Inventor: Shintaro Tsuji, Nagoya, Japan

[73] Assignee: Mitsubishi Denki Kabushiki Kaisha, Japan

[21] Appl. No.: 632,011

[22] Filed: Jul. 18, 1984

[30] Foreign Application Priority Data

| | | | |
|---|---|---|---|
| Jul. 22, 1983 | [JP] | Japan | 58-134017 |
| Oct. 7, 1983 | [JP] | Japan | 58-187821 |
| Jan. 27, 1984 | [JP] | Japan | 59-12986 |

[51] Int. Cl.[4] ..... B66B 1/18

[52] U.S. Cl. ..... 187/29 R; 340/20

[58] Field of Search ..... 187/29; 340/19, 20

[56] References Cited

U.S. PATENT DOCUMENTS

| | | | |
|---|---|---|---|
| 3,374,864 | 3/1968 | Port | 187/29 R |
| 4,124,102 | 8/1978 | Doane et al. | 187/29 R |
| 4,431,086 | 2/1984 | Moser et al. | 187/29 R |

FOREIGN PATENT DOCUMENTS

| | | |
|---|---|---|
| 51-17777 | 3/1976 | Japan . |
| 53-040843 | 10/1978 | Japan . |
| 54-14382 | 4/1979 | Japan . |
| 55-80659 | 1/1980 | Japan . |

*Primary Examiner*—B. Dobeck
*Assistant Examiner*—W. E. Duncanson, Jr.
*Attorney, Agent, or Firm*—Leydig, Voit & Mayer Ltd.

[57] ABSTRACT

A group-controlled elevator in which each hall is provided with destination buttons that will be manipulated by passengers and that produce signals corresponding to destination floors desired by the passengers, and in which destination calls produced by the manipulated destination buttons are automatically registered for predetermined cages. When a cage other than the cage for which the destination call is automatically registered, has arrived at the floor where said destination buttons are manipulated, the destination call is also registered even for this non-allotted cage. Therefore, whichever cage the passengers are on board, they are brought to their desired floors without the need of registering again the calls in the cage.

18 Claims, 11 Drawing Figures

APPARATUS FOR REGISTERING ELEVATOR CALL

BACKGROUND OF THE INVENTION

The present invention relates to an apparatus for registering elevator call by employing a hall operation board which issues a destination call to designate a destination floor where a cage will go.

In the conventional elevator, a hall call is registered by an up button or a down button in a hall, and a cage is called by the hall call. Occupants on board the cage which has arrived must register a cage call by depressing a destination button installed in the cage, so that the cage is carried to a desired floor. In the conventional elevator, as described above, the occupants are required to depress a call button in the hall and again in the cage.

A system has recently been proposed as disclosed in Japanese Utility Model Publication No. 53-40843 and Japanese Patent Publication No. 54-14382, according to which destination buttons same as those in the cage are provided in the halls of the floors commonly for each of the cages, and a destination floor display unit is provided for the halls for each of the cages. Therefore, when people on a hall depress destination buttons to register destination calls, the cages are suitably allotted for the destination calls, and floors of the allotted destination calls are displayed on the destination floor display unit, so that people waiting on the halls who have depressed the destination buttons are allowed to know the allotted cages and so that destination floors of the cages are also displayed for the people waiting on other halls. According to this system, as soon as a destination call is allotted, a cage call for an allotted cage is automatically registered. Therefore, people waiting on the hall are not required to depress the destination button. Another great advantage is that occupants in a crowded cage are liberated from such a possibility that they are not allowed to touch the buttons to register the cage calls.

There has also been proposed a system according to which a cage call of the floor corresponding to a destination call is automatically registered when an allotted cage has arrived at the floor where the destination button is depressed, as disclosed in Japanese Patent Laid-Open No. 55-80659.

However, it is too expensive and is not practical to provide the destination floor display unit of the above-mentioned system for each floor and for each cage.

Therefore, there can be contrived a system in which up hall lanterns and down hall lanterns are provided but without providing the destination floor display unit, the registered destination calls are divided into those of the up direction and those of the down direction and are registered as up calls and down calls, a cage is allotted for each of the calls, a hall lantern of the allotted cage is turned on to give the people in advance information related to the cage that is to be placed in service like the case when the up button and the down button are provided in a conventional manner, and the individual destination calls are registered in the form of a cage call for the allotted cage.

According to this system, the cage is not allotted for each of the destination calls and, hence, the destination floor display unit is not required. That is, the hall lantern which is turned on enables the people to know the cage on which they are going to board, i.e., the cage for which a cage call (destination call) for a desired floor is to be automatically registered, before the cage arrives.

Before the allotted cage has been determined to stop at the hall, the hall lantern is usually turned on to serve as information for a cage that is to be placed in service. When the cage is decided to be stopped responsive to hall call (up call, down call, destination call) or cage call, the hall lantern flashes irrespective of the allotted cage or the non-allotted cage, to serve as information related to the arrival of cage and direction in which the cage moves.

Therefore, when the allotted cage and the non-allotted cage arrive at the hall maintaining a small time interval, people waiting for the arrival of cage may get confused in deciding which one they should go on board, since the hall lantern produces the same information for the arrival of the allotted cage and the non-allotted cage. Therefore, occupants who have happened to go on board the non-allotted cage (for which the cage call has not been automatically registered) must depress again a destination button while they are on board the cage. This reduces the meaning of destination buttons in the hall, giving the occupants an undesirable impression that their expectation was not accomplished.

Further, when the non-allotted cage has arrived at the hall responsive to cage call before the allotted cage arrives at the hall responsive to allotment call, impatient people waiting in the hall may go on board the non-allotted cage. Even in this case, the occupants must depress again the destination button in the cage in the same manner as the above-mentioned case.

Further, in the elevator in which the hall is provided with an up button and a down button only, registration of cage call may often be expected depending upon utilization of floors of the building or relations among the floors. For instance, in a building accommodating offices, an up button (or a down button) of the floor where offices exist will be depressed in the lunch time to register the up call (or the down call). As the cage responds thereto, a cage staying on the upper (or lower) floor where restaurant exists is registered without exception. In such a case, if the system has been so constructed that the cage call of a particular floor (such as the floor of restaurant) is automatically registered when the cage has responded to the hall call, the occupants on that floor are liberated from having to depress the destination button while they are on board the cage.

Even in this system, however, occupants who wish to go to particular floors among the occupants on board the non-allotted cage, have to push again the destination buttons in the cage, in case the allotted cage and the non-allotted cage have arrived at the hall almost simultaneously, or when the non-allotted cage has arrived at the hall prior to the allotted cage.

SUMMARY OF THE INVENTION

The present invention was accomplished in view of the above-mentioned defects. According to an object of the present invention which is concerned with a group-controlled elevator in which cage call of a predetermined floor corresponding to a hall floor operated by a person is automatically registered for a predetermined cage, the cage call is automatically registered for two or more cages, so that he is brought to a desired floor without the need of depressing again the button in the cage whichever cage he may be on board.

According to another object of the present invention, each hall is provided with destination buttons which produce signals corresponding to destination floors of the cage when operated from the external side. When a signal is produced from the destination button at a time when the cages running in the same direction are stopped at the same floor, an operation control circuit of plurality of elevators serving the hall, work to register the signal as a cage call for the plurality of cages that run in the same direction and that are stopped at the same floor, so that a person is brought to his desired floor without the need of manually registering the cage call in the cage whichever cage he may be on board.

According to a further object of the present invention which is concerned with a group-controlled elevator in which cage call of a predetermined floor corresponding to a hall button depressed by a person is automatically registered for the allotted cage, the cage call is automatically registered for the non-allotted cage that has arrived earlier than the allotted cage, so that the person is brought to a desired floor without the need of depressing again the button in the cage even when he is on board a cage other than the allotted cage.

According to still further object of the present invention, the serving condition of the hall is detected, and when the serving condition is poorer than a reference value, cage call is automatically registered for the non-allotted cage that has arrived earlier, so that useless cage call will not be registered for the cage that has arrived earlier under the condition where people are less likely to go on board the cage that has arrived earlier.

BRIEF DESCRIPTION OF THE DRAWINGS

FIGS. 1 to 6 illustrate an embodiment of the present invention, in which:

FIG. 1 is a front view of a hall;

FIG. 2 is a block connection diagram of an electric circuit of an apparatus for group-controlling elevators;

FIG. 3 is a connection diagram of a circuit for registering hall call;

FIG. 4 is a connection diagram of a circuit for cancelling hall call;

FIG. 5 is a connection diagram of a circuit for registering cage call;

FIG. 6 is a connection diagram of a circuit for controlling hall lantern;

DESCRIPTION OF THE PREFERRED EMBODIMENTS

An embodiment of the present invention will be described below in conjunction with FIGS. 1 to 6. For the purpose of convenience, the following description deals with a case where a building has five stories and is equipped with two elevators. It should, however, be noted that the invention is also applicable to the cases where the buildings have different number of stories and different number of elevators.

Figure 1:
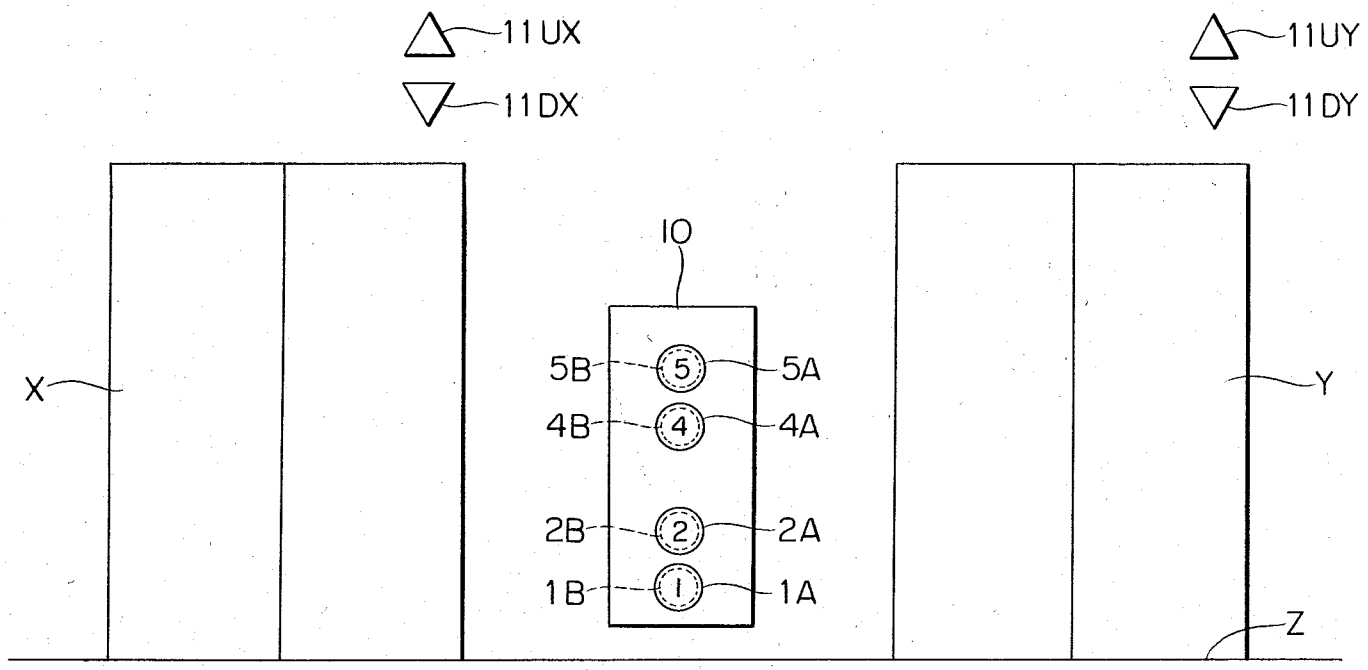

In FIG. 1, symbols X and Y denote doors of a hall served by the elevators Nos. 1 and 2, Z denotes a hall of the third floor, and 1A to 5A denote destination buttons for registering the destination calls corresponding to the first to fifth floors commonly for the elevators Nos. 1 and 2. The destination buttons have been arranged on a hall operation board 10 installed in the hall of the third floor. Reference numerals 1B to 5B denote destination button lamps that are contained in the destination buttons 1A to 5A of the first to fifth floors and that will be turned on when destination calls of the first to fifth floors are registered. Reference numerals 11DX, 11DY denote down hall lanterns provided in the hall of the third floor for the elevators Nos. 1 and 2, and 11UX, 11UY denote up hall lanterns.

Figure 2:
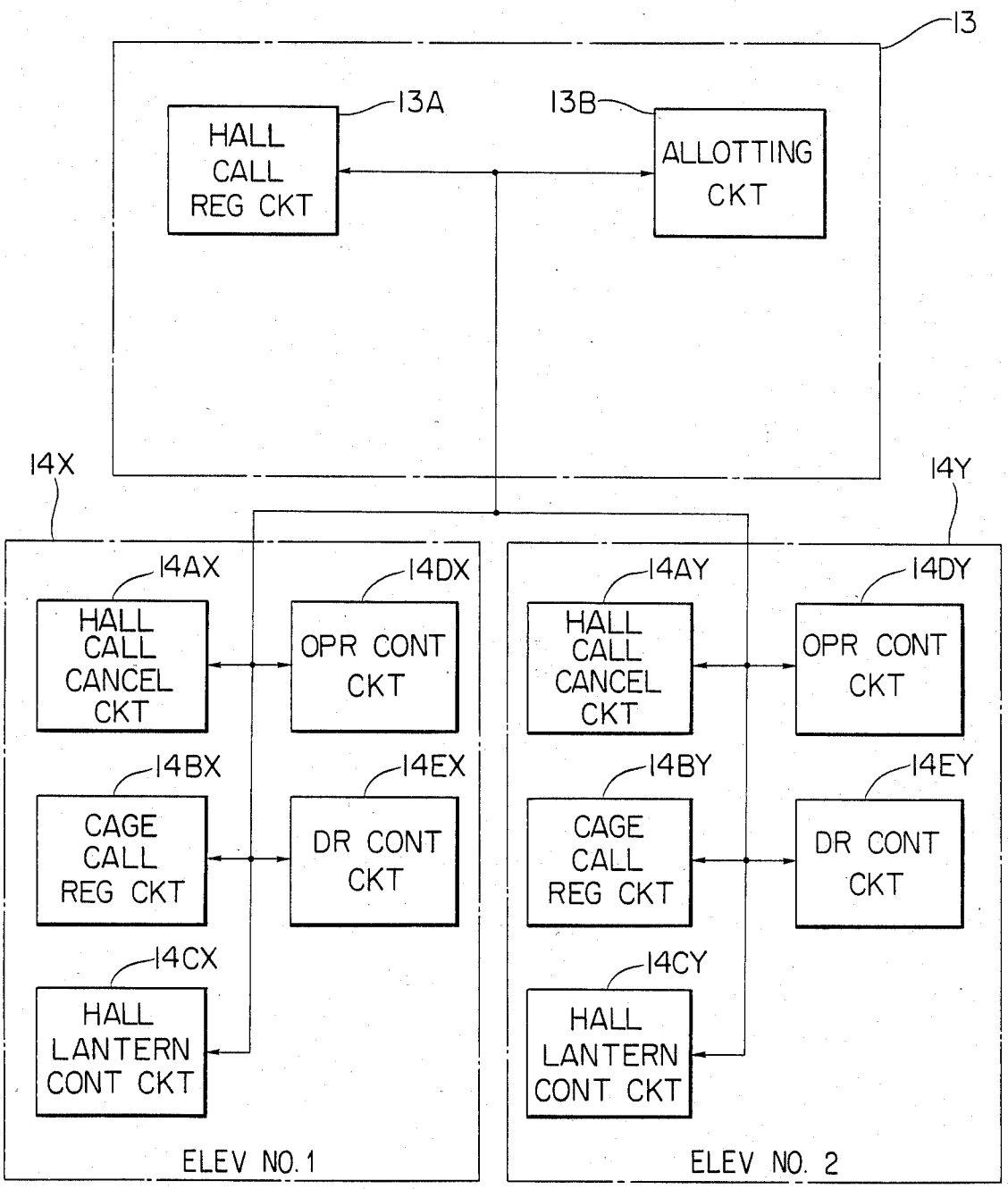

In FIG. 2, reference numeral 13 denotes an apparatus for group-controlling the elevators, 13A denotes a hall call registering circuit which is provided in the group-controlling apparatus 13 and which registers the hall calls (up call, down call, destination call) of each of the floors, and 13B denotes a known allotting circuit which selects and allots the most suitable cage that is to be served for the hall call. The allotting circuit 13B calculates in advance the times before the individual cages respond to the hall calls of each of the floors, and allots a cage for which the time becomes the shortest.

Reference numerals 14X, 14Y denote cage controllers of the elevators Nos. 1 and 2, 14AX and 14AY denote hall call cancelling circuits that are provided in the cage controllers 14X, 14Y and that produce hall call cancel instruction signals (mentioned later) for each of the floors, 14BX and 14BY denote cage call registering circuits for registering cage calls for each of the cages, 14CX and 14CY denote hall lantern control circuits for controlling turn on of hall lanterns on each of the floors for each of the cages, 14DX and 14DY denote widely known operation control circuits which control fundamental operation of the cages such as running and stopping, such that the cages will work responsive to cage calls or hall calls that are allotted, and 14EX and 14EY denote widely known door control circuits which control the opening and closure of the doors of the cages.

Figure 3:
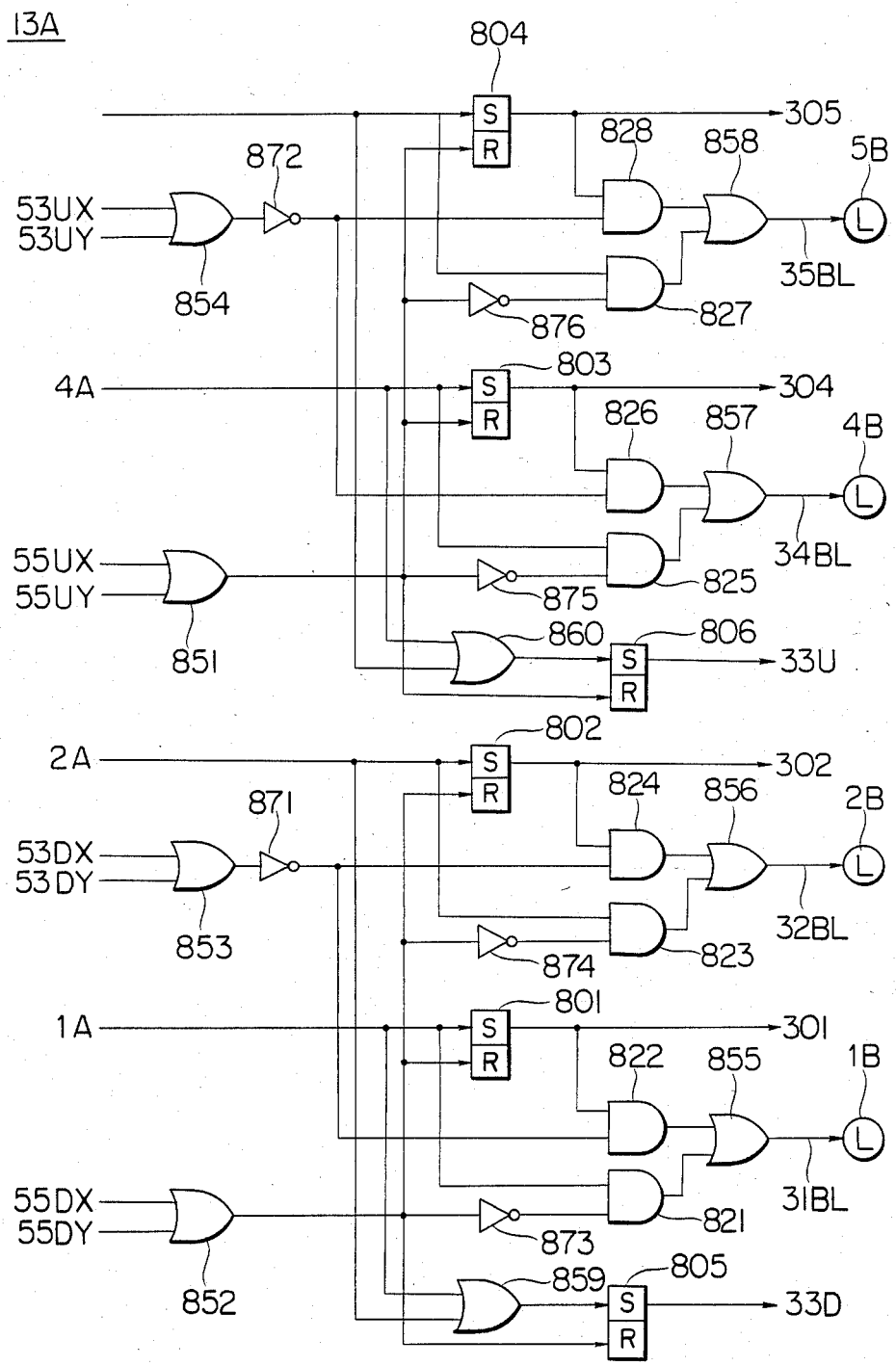
Figure 4:
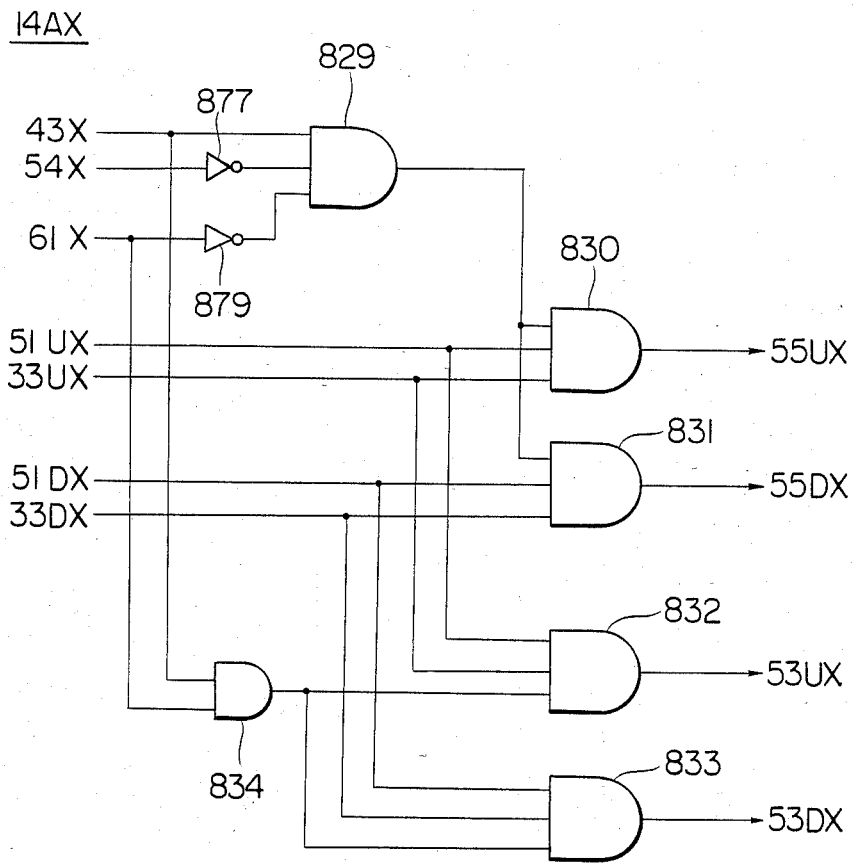
Figure 5:
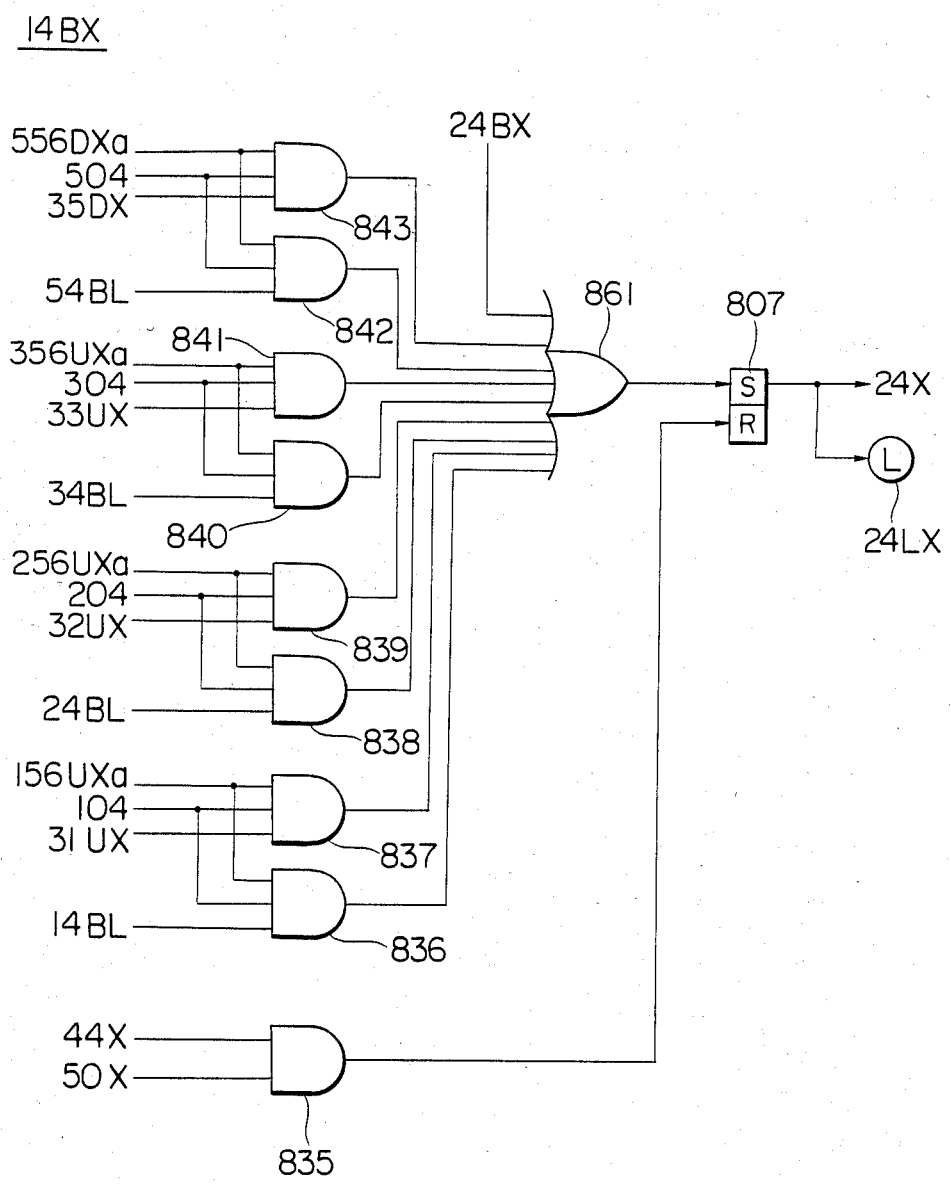
Figure 6:
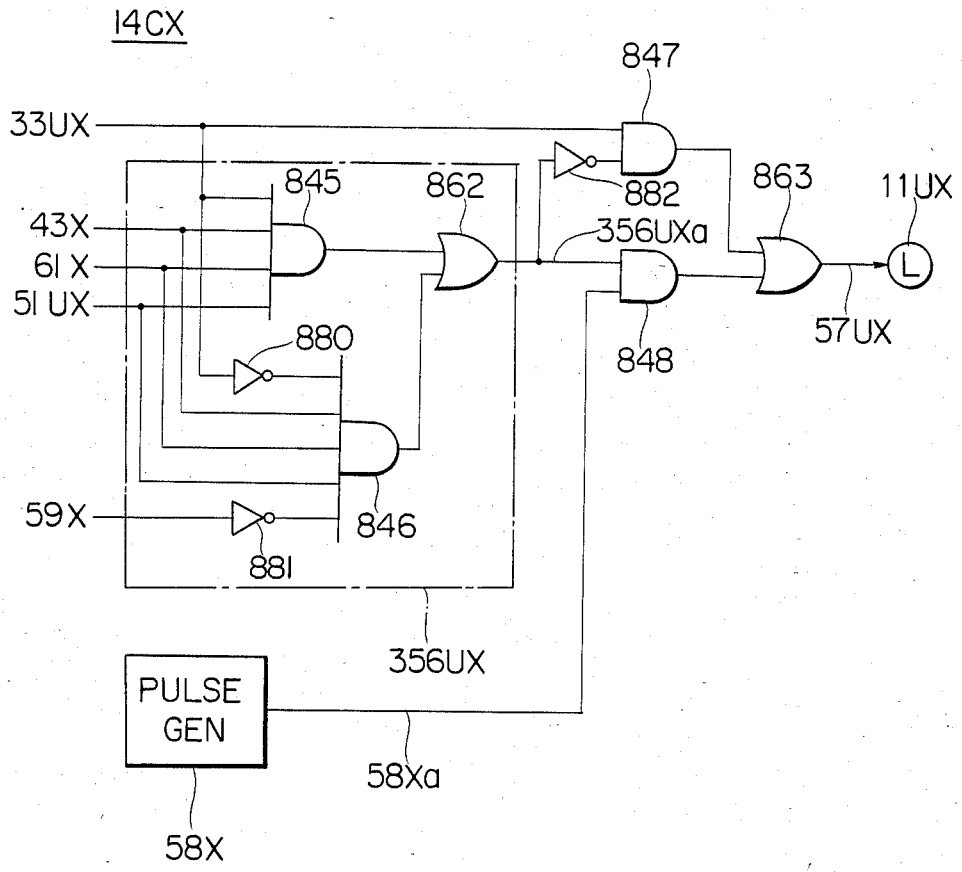

FIG. 3 shows a hall call registering circuit 13A that is corresponded to the third floor, FIG. 4 shows a hall call cancelling circuit 14AX of the elevator No. 1 that is corresponded to the third floor, FIG. 5 shows a cage call registering circuit 14BX of the elevator No. 1 that is corresponded to the fourth floor, and FIG. 6 shows a hall lantern control circuit 14CX of the elevator No. 1 that is corresponded to the hall of up direction of the third floor. Circuits corresponding to other floors and other direction, and the circuits for the elevator No. 2 have also been constructed in the same manner.

In FIG. 3, reference numerals 301 to 305 denote designation call signals that assume the high level when destination calls for the first to fifth floors are registered by the hall operation board 10 of the third floor, and 33U and 33D denote an up call signal and a down call signal that assume the high level when the up call and the down call from the third floor are registered, and that are produced by the hall call registering circuit 13A.

Reference numerals 31BL to 35BL denote destination button lamp turn-on instruction signals that assume the high level when the destination button lamps 1B to 5B arranged on the hall operation board 10 of the third floor are turned on, 53UY and 53DY denote up and down destination button lamp turn-off instruction signals corresponding to the third floor of the elevator No. 2, 55UX and 55DX denote an up call cancellation instruction signal and a down call cancellation instruction signal that assumes the high level when the up call and down call from the third floor are cancelled for the elevator No. 1, and 55UY and 55DY denote an up call cancellation instruction signal and a down call cancellation instruction signal for the elevator No. 2. These signals are produced by the hall call cancelling circuits 14AX, 14AY.

Reference numerals 801 to 806 denote memories consisting of flip-flop circuits. When a signal of the high level is input to a point S, the content of memory is set to the high level. When a signal of the high level is input to a point R, the content of memory is reset to the low level even when the signal of the high level is input to the point S.

In FIG. 4, reference numeral 43X denotes a cage position signal which assumes the high level when the elevator No. 1 stays at the third floor, and 51UX and 51DX denote an up direction signal and a down direction signal which assumes the high level when the elevator No. 1 runs in the up direction and in the down direction. These signals are produced by the operation control circuit 14DX.

Reference numeral 53UX denotes an up destination button lamp turn-off instruction signal which assumes the high level when the destination button lamps corresponding to the floors higher than the third floor (i.e., destination button lamps 4B, 5B of the fourth and fifth floors) of the elevator No. 1 are turned off among the destination button lamps 1B to 5B of the hall operation board 10 of the third floor, 53DX denotes a down destination button lamp turn-off instruction signal which assumes the high level when the destination button lamps corresponding to the floors lower than the third floor (i.e., destination button lamps 1B, 2B of the first and second floors) of the elevator No. 1 are turned off, 54X denotes a door switch signal which assumes the high level when the door of cage of the elevator No. 1 is completely closed, and 33DX denotes a down allotting signal which assumes the high level when the elevator No. 1 is allotted to the down call of the third floor, and which is produced by the allotting circuit 13B.

In FIG. 5, reference numerals 14BL, 24BL and 54BL denote destination button lamp turn-on instruction signals that assume the high level when destination button lamps (not shown) bound for the fourth floor arranged on the hall operation boards (not shown) of the first, second and fifth floors are turned on, and that are produced by the hall call registering circuit 13A (not shown) corresponded to the fourth floor.

Reference numerals 31UX to 33UX denote up allotting signals that assume the high level when the elevator No. 1 is allotted to the up calls from the first to third floors, and 35DX denotes a down allotting signal that assumes the high level when the elevator No. 1 is allotted to the down call from the fifth floor. These signals are produced by the allotting circuit 13B. Reference numeral 44X denotes a cage position signal which assumes the high level when the elevator No. 1 stays on the fourth floor. Reference numeral 24BX denotes a cage call button signal of the fourth floor that assumes the high level when a destination button (not shown) bound for the fourth floor installed in the cage of the elvator No. 1 is depressed, 24X denotes a cage call signal of the fourth floor that assumes the high level when the cage call of the elevator No. 1 is registered, 24LX denotes a cage call button lamp of the fourth floor that is contained in a destination button of the fourth floor of the elevator No. 1, and that turns on when a cage call of the fourth floor is registered, and 50X denotes a stop signal that assumes the high level when the elevator No. 1 is stopped.

Reference numerals 204, 304 and 504 denote destination call signals bound for the fourth floor produced by the hall operation boards (not shown) of the first, second and fifth floor, 156UXa and 256UXa denote up arrival display instruction signals for the first and second floors, and 556DXa denotes a down arrival display instruction signal for the fifth floor. Reference numeral 807 denotes a flip-flop circuits 801 to 806 of FIG. 3.

In FIG. 6, reference numeral 57UX denotes an up hall lantern turn-on instruction signal which assumes the high level when the up hall lantern llUX is turned on, and which assumes the low level when it is turned off, and 58X denotes a synchronizing pulse generator which produces synchronizing pulse signals 58Xa of the high level and low level repetitively after every 0.5 second.

Reference numeral 59X denotes a door open-close instruction signal which assumes the high level when the door of the elevator No. 1 is to be closed, and which assumes the low level when it is to be opened, and 61X denotes a call response signal which assumes the high level when the elevator No. 1 is responding to the call (i.e., during a period of from when the door is opened after the stop has been determined to a moment just before the door is completely closed). These signals are produced by the door control circuit 14EX.

Reference numeral 356UX denotes an arrival display timing setting circuit which is provided in the hall lantern control circuit 14CX of the elevator No. 1, which controls the arrival information display timing of the up hall lantern 11UX of the third floor of the elevator No. 1, and which produces an up arrival display instruction signal 356UXa that assumes the high level at a time when the arrival information of the up direction is to be displayed on the third floor for the elevator No. 1.

Reference numerals 821 to 848 (FIGS. 3 to 6) denote AND gates. Among them, the AND gates 836, 838, 840 and 842 works as auxiliary cage call registration instruction means that produce instructions to register cage calls for the first, second, third, and fifth floors as destination floors. Reference numerals 851 to 863 denote OR gates, and 871 to 882 denote NOT gates.

It is now presumed that the elevator No. 1 is on the second floor in the up direction, and the elevator No. 2 is on the first floor in the up direction. In this case, the circuit (FIG. 4) for the third floor of the hall call cancelling circuit 14AX of the elevator No. 1 produces a signal of the low level. Therefore, AND gates 829, 834 produce outputs of the low level, and AND gates 830 to 833 produce outputs of the low level. Namely, up call cancellation instruction signal 55UX of the third floor, down call cancellation instruction signal 55UX of the third floor, down call cancellation instruction signal 55DX, up destination button lamp turn-off instruction signal 53UX, and down destination button lamp turn-off instruction signal 53DX, all assume the low level. The hall call cancellation circuit (not shown) of the elevator No. 2 also produces the same signal.

A person who came to the hall of the third floor may depress the destination button 4A of the hall operation board 10. A destination button signal 4A (high level) causes the content of memory 803 (FIG. 3) to be set to the high level, and the destination call signal 304 of the fourth floor assumes the high level. As mentioned above, however, the signals 55UX, 55UY have the low level, and the OR gate 851 produces output of the low level; i.e., the memory 803 is not reset. Further, the OR gate 854 produces out of the low level, and the NOT gate 872 produces output of the high level. Therefore, the AND gate 826 produces output of the high level, and the destination button lamp turn-on instruction signal 34BL bound for the fourth floor assumes the high level via the OR gate 857. Accordingly, the destination button lamp 4B bound for the fourth floor turns on to let the people know that the destination call bound for the fourth floor is registered. Further, since the OR gate 860 produces output of the high level, the content of memory 806 is set to the high level, up call of the third floor is registered, and up call signal 33U of the third floor assumes the high level. The allotting circuit 13B allots a cage, for example, elevator No. 1 that is expected to be capable of responding to the up call of the third floor within the shortest period of time, and up allotting signal 33UX of the third floor (FIG. 6) assumes the high level. In the hall lantern control circuit 14CX of the elevator No. 1 (FIG. 6) corresponded to the hall of up direction of the third floor, therefore, the up arrival display instruction signal 356UXa of the third floor assumes the low level, and the NOT gate 882 produces output of the high level. The AND gate 847 produces output of the high level, and the OR gate 863 produces a third-floor up hall lantern turn-on instruction signal 57UX of the high level. Accordingly, the up hall lantern 11UX of the third floor of the elevator No. 1 turns on, to let the people on the third floor know that the elevator No. 1 is allotted.

As the elevator No. 1 leaves the second floor and arrives at the third floor, the third-floor cage position signal 43X (FIG. 6) assumes the high level. As the stop is decided responsive to the up call of the third floor, the call response signal 61X assumes the high level, and the hall lantern control circuit 14CX of the elevator No. 1 (FIG. 6) corresponded to the hall of up direction of third floor produces third-floor up allotting signal 33UX and up signal 51UX both having the high level. Therefore, the AND gate 845 produces output of the high level, and third-floor up arrival display instruction signal 356UXa assumes the high level via the OR gate 862, to indicate that it is a moment to display the arrival information. Responsive to the output of NOT gate 882, the AND gate 847 produces output of the low level to interrupt the display of information. On the other hand, the output of AND gate 848 assumes the high level for a period of 0.5 second during which a synchronizing pulse 58Xa generated by the synchronizing pulse generator 58X assumes the high level. Therefore, the OR gate 863 produces the up hall lantern turn-on instruction signal 57UX of the high level. Further, output of the AND gate 848 assumes the low level for a period of 0.5 second during which the synchronizing pulse signal 58Xa assumes the low level. Therefore, the OR gate 863 produces the up hall lantern turn-on instruction signal 57UX of the low level. Consequently, the up hall lantern turn-on instruction signal 57UX assumes the high level and low level repetitively maintaining a period of one second (high for 0.5 second and low for 0.5 second), and the up hall lantern 11UX of the third floor flashes, i.e., turns on for 0.5 second and turns off for 0.5 second, letting the people on the third floor know that the elevator No. 1 of the up direction has arrived.

On the other hand, in the hall call cancelling circuit 14AX of the elevator No. 1 (FIG. 4) corresponded to the third floor, when the elevator No. 1 arrives at the third floor (determined to stop), the third-floor cage position signal 43X and the call response signal 61X assume the high level, and the AND gate 834 produces output of the high level. Since the up signal 51UX and the third-floor up allotting signal 33UX are assuming the high level, the AND gate 832 produces the up destination button lamp turn-off instruction signal 53UX of the high level. In the hall call registering circuit 13A (FIG. 3) corresponded to the third floor, therefore, the OR gate 854 produces output of the high level, the NOT gate 872 produces output of the low level, and output of the AND gate 826 changes from the high level to the low level. In this case, the destination button signal 4A for the fourth floor is assuming the low level and, hence, output of the AND gate 825 assumes the low level. Therefore, the OR gate 857 produces fourth-floor destination button turn-on instruction signal 34BL of the low level, to turn off the destination button lamp 4B bound for the fourth floor in the hall operation board 10 of the third floor. Even when the destination button 5A bound for the fifth floor is operated, the destination button lamp 5B is turned off in the same manner.

In the cage call registering circuit 14BX of the elevator No. 1 (FIG. 5) corresponded to the fourth floor, furthermore, when the elevator No. 1 arrives at the third floor in the up direction (determined to stop), the third-floor up arrival display instruction signal 356UXa, third-floor up allotting signal 33UX, and destination call signal 304 bound for the fourth floor all assume the high level. Therefore, the AND gate 841 produces output of the high level, the OR gate 861 produces output of the high level, content of the memory 807 is set to the high level, and cage call signal 24X bound for the fourth floor assumes the high level. In the case of the elevator No. 1, therefore, the cage call button lamp 24LX bound for the fourth floor turns on, to let the people in the cage know that the cage call for the fourth floor is automatically registered. That is, at the time when the people go on board the cage of the elevator No. 1 on the third floor to get to the fourth floor, the cage call bound for the fourth floor has already been registered for the elevator No. 1, and the occupants need not depress the destination button in the cage.

Thus, as the allotted cage which has been displayed information by turning the hall lantern on, responds to the hall call, the destination calls of the same direction as the cage that had been registered thus far are then automatically registered at once as cage call for the allotted cage.

On the third floor, as the people go one board or get out of the elevator No. 1 and as the door open-close instruction signal 59X (FIG. 6) assumes the high level, the cage starts to close the door. In the hall call cancelling circuit 14AX, the call response signal 61X assumes the low level just before the door is completely closed, and the NOT gate 879 produces output of the high level. Just before the door is completely closed, therefore, the door switch signal 54X assumes the low level, the NOT gate 877 produces output of the high level, the cage stays on the third floor, the signal 43X assumes the high level and, hence, the AND gate 829 produces output of the high level. The up signal 51UX of the elevator No. 1 and the third-floor up allotting signal 33UX both have the high level. Therefore, the level of the third-floor up call cancellation instruction signal 55UX produced by the AND gate 830 changes from the low level to the high level.

In the circuit (FIG. 3) for the third floor of the hall call registering circuit 13A, therefore, the OR gate 851 produces output of the high level, and contents of the memories 803, 806 are all reset to the low level, whereby the destination call signal 304 for the fourth floor assumes the low level to cancel the registration of destination call for the fourth floor. Further, the up call signal 33U of the third floor assumes the low level to cancel the registration of up call of the third floor. The allotting circuit 13B resets the up allotting signal 33UX of the third floor of the elevator No. 1 to the low level.

On the other hand, just before the door of the cage of the elevator No. 1 is completely closed, the call response signal 61X changes from the high level to the low level. In the hall lantern control circuit 14CX (FIG. 6) corresponded to the third floor, therefore, the AND gate 845 produces output of the low level, and the OR gate 862 produces output of the low level. Since the arrival display instruction signal 356UXa assumes the low level, the AND gate 848 produces output of the low level, the OR gate 863 produces output, i.e., produces an up hall lantern turn-on instruction signal 57UX of the third floor of the low level, and the up hall lantern 11UX of the third floor which is flashing, is turned off.

As the door of the cage of the elevator No. 1 is completely closed, the door switch signal 54X is changed from the low level to the high level. In the hall call cancelling circuit 14AX (FIG. 4) corresponded to the third floor, therefore, the NOT gate 877 produces output of the low level, the AND gate 829 produces output of the low level, and the AND gate 830 produces output of the low level. Therefore, the up call cancellation instruction signal 55UX of the third floor assumes the low level, enabling the hall call of the up direction to be registered on the third floor.

As the door is completely closed, and the cage of the elevator No. 1 which has left the third floor arrives at the fourth floor, the cage position signal 43X of the third floor assumes the low level, and the cage position signal 44X of the fourth floor assumes the high level. As the elevator No. 1 is determined to be stopped responsive to the cage call 24X of the fourth floor and stops on the fourth floor, the stop signal 50X assumes the high level. In the cage call registering circuit 14BX, therefore, the AND gate 835 produces output of the high level to reset the content of memory 807 to the low level. The cage call signal 24X of the fourth floor then assumes the low level, the cage call button lamp 24LX bound for the fourth floor in the cage turns off, and the occupants in the cage are allowed to know that the cage has stopped responsive to the cage call of the fourth floor.

In the foregoing was mentioned the operation under the condition where the allotted cage (elevator No. 1) has responded to the hall call.

Next, it is pressumed that a person depresses a fourth-floor-bound button 4A of the hall operation board 10 on the third floor under the condition where the elevator No. 1 stays on the first floor in the up direction and the elevator No. 2 stays on the second floor in the up direction, contrary to the above-mentioned case. In this case, as mentioned earlier, the fourth-floor-bound call signal 304 and the up call signal 33U from the third floor assume the high level, and the fourth-floor-bound button lamp 4B turns on. The allotting circuit 13B allots the elevator No. 2 which is expected to be capable of responding to the up call from the third floor within the shortest period of time, and the up hall lantern 11UY of the elevator No. 2 turns on the third floor.

As the elevator No. 2 arrives at the third floor in the up direction, the fourth-floor-bound button lamp 4B turns off, the up hall lantern 11UY on the third floor flashes after every 0.5 second to let tht people know the arrival, and a cage call of fourth floor is automatically registered on the elevator No. 2.

When the elevator No. 2 has arrived at the third floor responsive to the up call of third floor, it is now presumed that the elevator No. 1 has started from the first floor carrying occupants who go to the third floor, and is so determined as to stop at the third floor in the up direction. In this case, the cage position signal 43X at the third floor of the elevator No. 1 assumes the high level, the call response signal 61X assumes the high level, and the up direction signal 51UX assumes the high level. However, since the up allotting signal 33UX at the third floor assumes the low level, the AND gate 845 produces output of the low level in the hall lantern control circuit 14CX (FIG. 6) of the elevator No. 1 in the up direction hall of the third floor. Since the door open-close instruction signal 59X is assuming the high level, the NOT gate 881 produces output of the low level, both the AND gate 846 and the OR gate 862 produce outputs of the low level, and the third floor up arrival display instruction signal 356UXa remains at the low level. Therefore, the up hall lantern 11UX of the third floor does not flash, the AND gates 840, 841 produce outputs of the low level in the cage call registering circuit 14BX of the elevator No. 1 corresponded to the fourth floor (FIG. 5), and the cage call from the fourth is not automatically registered for the elevator No. 1.

Then, as the cage of the elevator No. 1 stops, and the door open-close instruction signal 59X changes from the high level to the low level to open the door, the NOT gates 880, 881 produce outputs of the high level in the hall lantern control circuit 14CX (FIG. 6) corresponded to the up-direction hall of the third floor, whereby the AND gate 846 produces output of the high level, the OR gate 862 produces output of the high level, and the third floor up arrival display instruction signal 356UXa changes from the low level to the high level. Therefore, as the elevator No. 1 starts to open the door, the up hall lantern 11UX of the third floor flashes after every 0.5 second to let the people know the arrival of the cage. Here, although the fourth-floor-bound call signal 304 is assuming the high level, the up allotting signal 33UX of the third floor is of the low level, and the destination button lamp turn-on instruction signal 34BL bound for the fourth floor is assuming the low level (i.e., the fourth-floor-bound button lamp 4B is turned off). Therefore, the AND gates 840 and 841 produce outputs of the low level, and the cage call from the fourth floor is not automatically registered for the elevator No. 1.

Further, when the up hall lantern 11UX is flashing with the door of the cage of the elevator No. 1 being opened on the third floor, a person rushing for the hall may depress the fourth-floor-bound button 4A to go to the fourth floor. In this case, both the up call cancellation instruction signals 55UX, 55UY are assuming the low level, and the OR gate 851 is producing output of the low level. Therefore, content of the memory 803 remains at the high level, and the fourth-floor-bound call signal 304 remains at the high level. On the other hand, since the up destination button lamp turn-off instruction signal 53UX has already been assuming the high level, the OR gate 854 produces output of the high level, the NOT gate 872 produces output of the low level, and the AND gate 826 produces output of the low level. Since the NOT gate 875 produces output of the high level, the AND gate 825 produces output of the high level during a period in which the destination button 4A is being depressed, and the destination button lamp turn-on instruction signal 34BL bound for the fourth floor assumes the high level via the OR gate 857, so that the fourth-floor-bound button lamp 4B turns on. The fourth-floor-bound button lamp 4B turns off if hand is detached from the destination button 4A.

In the cage call registering circuit 14BX of the elevator No. 1 (FIG. 5) corresponded to the fourth floor, therefore, the AND gate 840 produces output of the high level so far as the destination button 4A is being depressed, the OR gate 861 produces output of the high level, and content of the memory 807 is set to the high level. Accordingly, the cage call for the fourth floor is also registered automatically for the elevator No. 1.

When a destination button is depressed in the hall as mentioned above, the cage call is automatically registered for a cage for which the hall lantern is flashing to display the arrival information, even when the cage may not be allotted one. Therefore, the person is allowed to register the cage call of a desired floor whichever cage he may be on board. That is, the elevator can be used more conveniently.

Next, the elevator No. 1 staying on the first floor may arrive at the third floor in the up direction carrying occupants who wish to go to the third floor earlier than the elevator No. 2 while its departure is being delayed on the second floor though the up call has been allotted thereto from the third floor. In this case, as the elevator No. 1 which is not the allotted one stops at the third floor and starts to open the door, the up arrival display instruction signal 356UXa of the third floor assumes the high level, and the up hall lantern 11UX flashes to let the people know the arrival of the cage. However, since the third floor up allotting signal 33UX assumes the low level, both the up call cancellation signal 55UX of the third floor and the up destination button turn-off instruction signal 53UX of the third floor assume the low level. Therefore, the fourth-floor-bound call signal 304, the destination button lamp turn-on instruction signal 34BL bound for the fourth floor, and the third floor up call signal 33U all assume the high level, and the fourth-floor-bound button lamp 4B is not turned off. At the same time, output of the AND gate 840 changes from the low level to the high level, content of the memory 807 is set to the high level via the OR gate 861, and the cage call for the fourth floor is also registered automatically for the elevator No. 1.

As mentioned above, the destination call of the same direction as that of the allotted cage is automatically registered for a cage which has arrived earlier than the allotted cage responsive to the cage call, and for which the hall lantern is flashing to display the arrival. Therefore, even when impatient people go on board the cage that has arrived earlier, their cage calls for their desired floors are registered; i.e., the elevator is used more conveniently.

As for the non-allotted cage, when the door is started to close (door open-close instruction signal 59X has the high level) after the people have went on board or have got out of the cage, the up arrival display instruction signal 356UXa of the third floor assumes the low level, and the up hall lantern 11UX of the third floor turns off.

Next, below is presumed the case in which both the elevator No. 1 and No. 2 are opening the doors in the up direction responsive to the cage call of the third floor though the up call has not been registered by the third floor. In this case, if a person who comes first to the hall depresses the fourth-floor-bound button 4A to go to the fourth floor, the fourth-floor-bound call signal 304 is readily changed from the low level to the high level, since the up call cancellation instruction signals 55UX, 55UY of the third floor are of the low level. The up call signal 33U of the third floor also changes from the low level to the high level. If the allotting circuit 13B allots the elevator No. 1 for the up call of the third floor, the up allotting signal 33UX of the third floor assumes the high level, and the up destination button lamp turn-off instruction signal 53UX of the elevator No. 1 assumes the high level. Therefore, the fourth-floor-bound button lamp 4B turns on only during a moment at which the fourth-floor-bound button 4A is depressed, and the cage call is automatically registered during this moment for the elevators Nos. 1 and 2.

According to the above-mentioned embodiment, the cage call is automatically registered by depressing a destination button on the hall for a cage which has arrived at the floor and for which the hall lantern is flashing to indicate the arrival, even when the cage is not the allotted one. Therefore, the occupants are permitted to register cage calls of their desired floors whichever cage they may be on board, and the elevator can be used more conveniently.

In particular, even when people on the hall may newly depress destination buttons while the two elevators are staying on the same floor in the same direction, the cage call is automatically registered by the destination button for the cages of the two elevators. Therefore, even when people go on board the cages nonchalantly, they are brought to their desired floors without the need of registering again the cage call in the cage.

Figure 7:
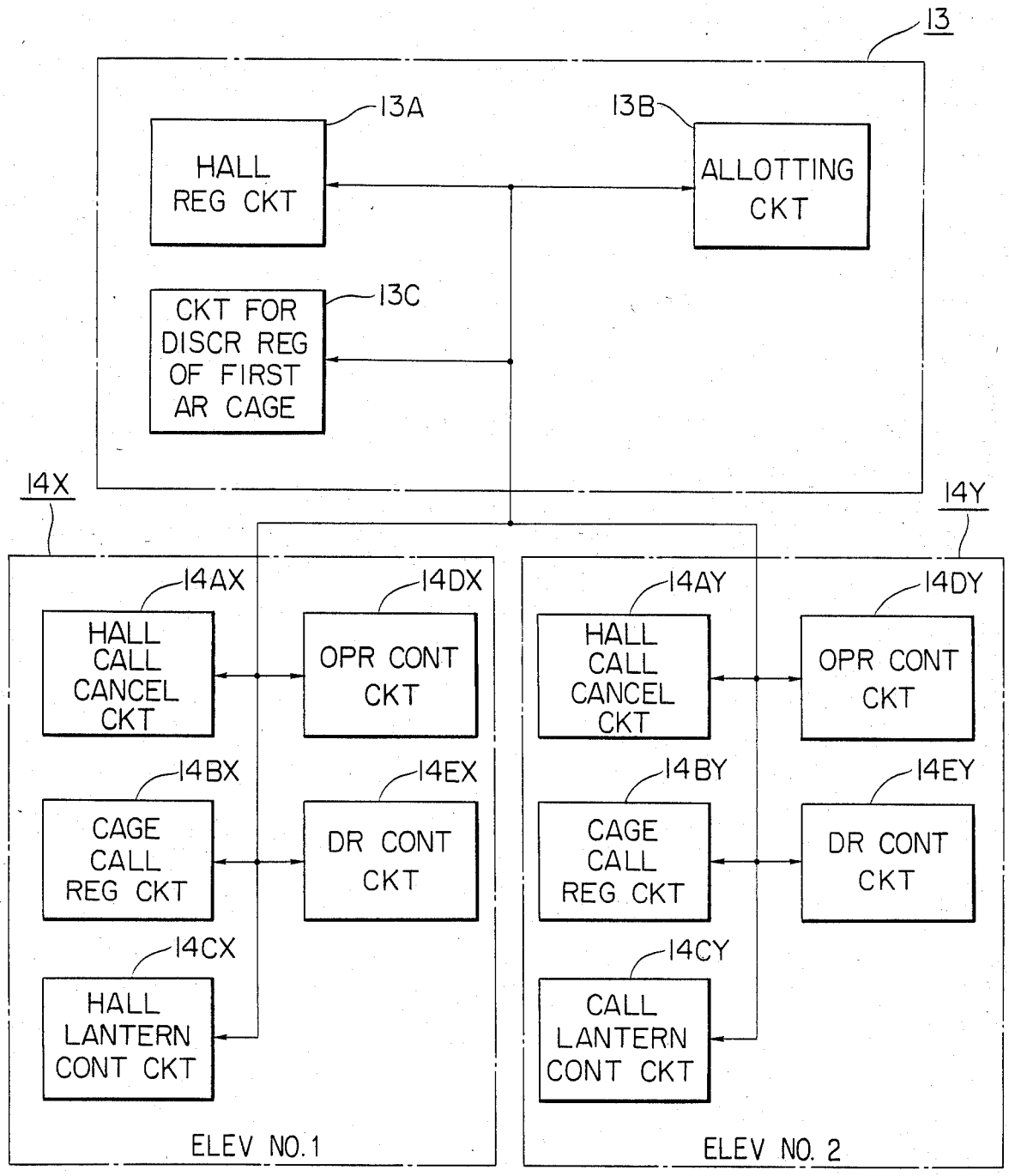
FIGS. 7–9 are diagrams of a logic circuit for discriminating the registration of a cage that has arrived earlier according to another embodiment.
Figure 8:
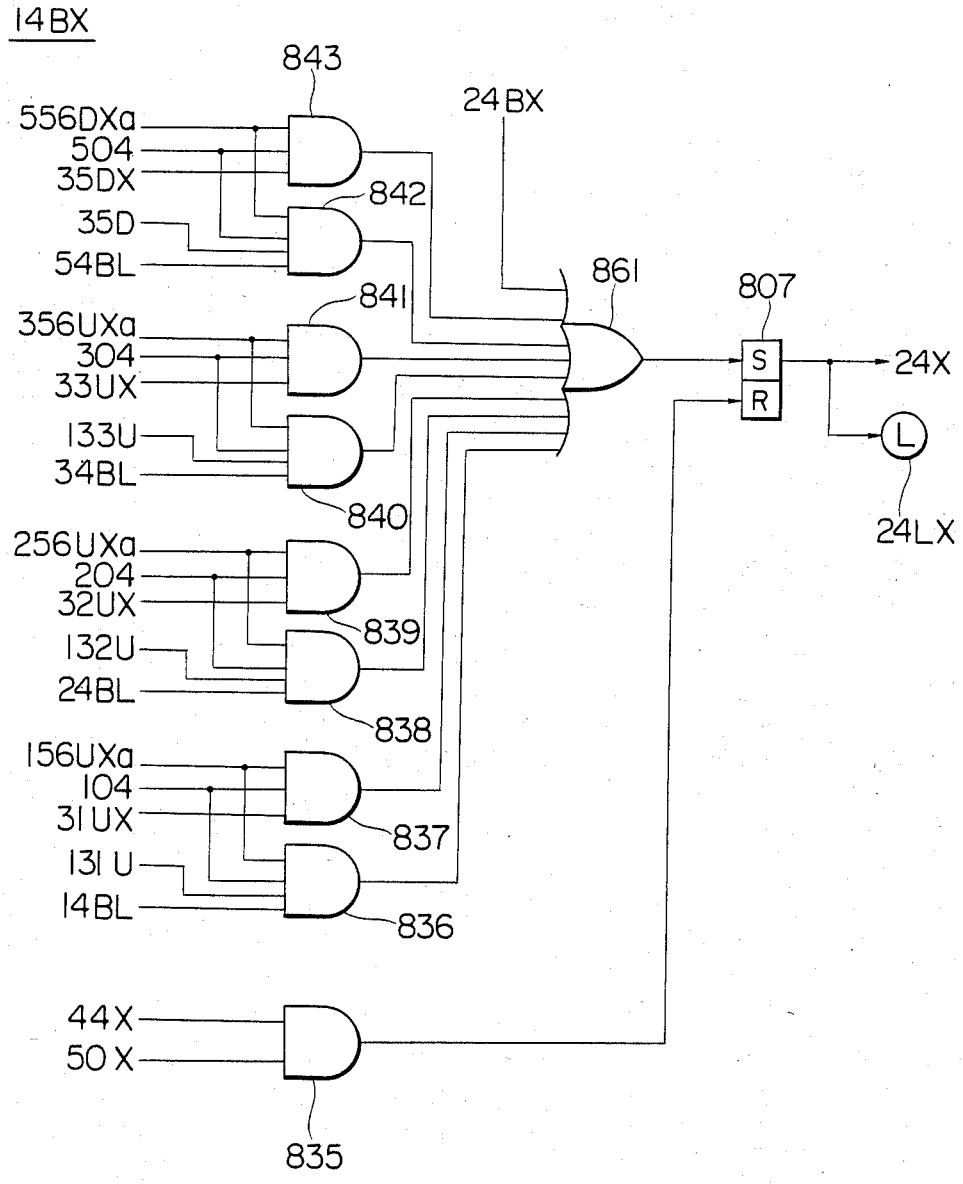
Figure 9:
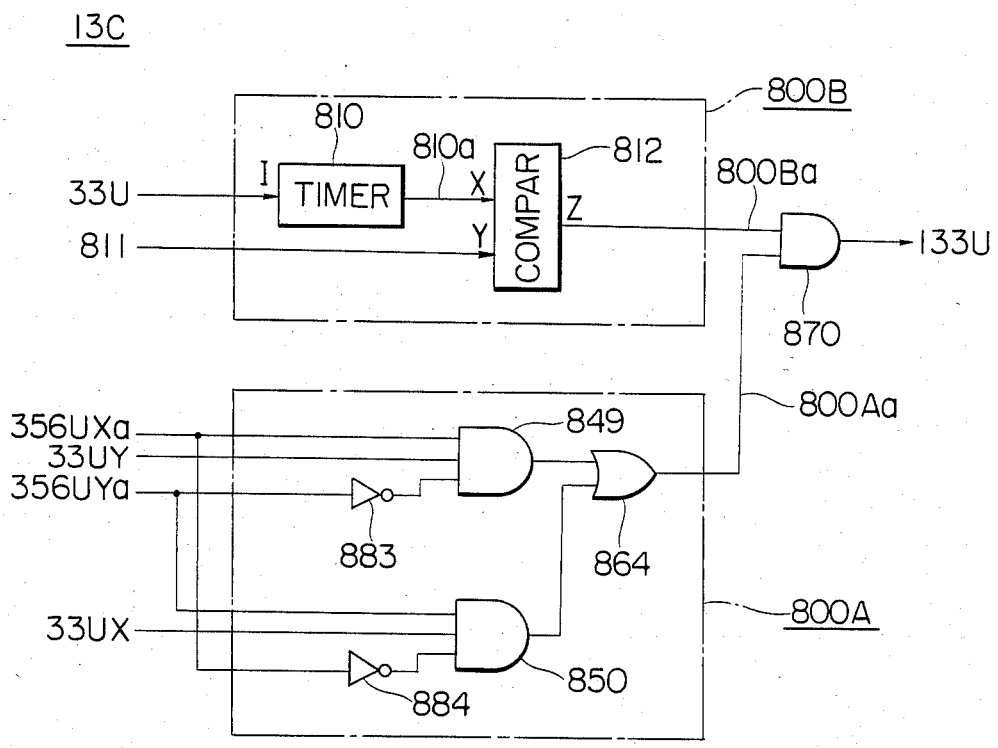

FIGS. 7 to 9 illustrate another embodiment of the present invention, in which the same reference numerals as those of FIGS. 1 to 6 denote the same or corresponding portions.

In FIG. 7, what makes the present invention characteristic is a circuit 13C for discriminating the registration of first-arrival cage, which estimates the serving condition on each of the halls, and which validates or invalidates the registration of cage call by the hall operation board 10 fot the cage that has arrived first though it may not be the allotted cage, depending upon the estimated results.

The setup of FIG. 8 is different from the setup of FIG. 5 with regard to discrimination signals 131U to 133U, 135D which are produced by the circuit 13C for discriminating the registration of first-arrival cage, which are corresponded to the up-direction halls of the first to third floors and to the down-direction hall of the fifth floor, and which assume the high level only when the registration of cage call by the hall operation board is validated for the cage other than the allotted cage.

FIG. 9 shows the circuit 13C for discriminating the registration of first-arrival cage, which is corresponded to the up-direction hall of the third floor, wherein reference numeral 33UY denotes an up allotting signal that assumes the high level when the elevator No. 2 is allotted to the up call from the third floor. The signal 33UY is produced by the allotting circuit 13B.

Reference numeral 356UYa denotes an up arrival display instruction signal for the third floor of the elevator No. 2, 800A denotes a first-arrival cage detector circuit in the up direction of the third floor provided in the up-direction circuit of the third floor of the circuit 13C for discriminating the registration of first-arrival cage, 800Aa denotes a first-arrival cage detection signal in the up direction of third floor that assumes the high level only when there is a cage that has arrived earlier than the cage that is allotted to the up call of the third floor, 800B denotes a serving condition discriminating circuit in the up direction of third floor, 800Ba denotes a serving condition discrimination signal in the up direction of third floor that assumes the high level when it is so discriminated that the serving condition of up call of the third floor is poorer than a reference value, 810 denotes a timer which counts the duration period after the input signal has assumed the high level and which produces zero when the input signal assumes the low level, 180*a* denotes a signal which is produced by the timer 810 and which represents a duration period of up call of the third floor, 811 denotes a constant-value signal that represents a time of 20 seconds, 812 denotes a comparator which produces output of the high level at the point Z when the input signal at the point X is equal to or greater than the input signal at the point Y, and which produces output of the low level at the point Z when the input signal at the point X is smaller than the input signal at the point Y, reference numerals 849, 850 and 870 denote AND gates, wherein the AND gate 870 works as means which permits the cage call to be automatically registered for the cage that has arrived first, 864 denotes an OR gate, and 883, 884 denote NOT gates.

Operation of the embodiment will be described below.

It is now presumed that the elevator No. 1 staying on the first floor has arrived at the third floor in the up direction carrying third floor-bound people earlier than the elevator No. 2, while the departure of the elevator No. 2 to which the up call from the third floor has been allotted, is being delayed on the second floor.

As described in the first embodiment, the elevator No. 1 which is not the allotted one stops at the third floor and starts to open the door. Then, the up arrival display instruction signal 356UXa of the third floor assumes the high level, and the up hall lantern 11UX flashes to let the people know the arrival of the cage.

In the up-direction circuit (FIG. 7) of the circuit 13C for discriminating the registration of first-arrival cage, if the timer 810 produces a 10 seconds of duration time signal 810*a* of up call of third floor, the comparator 812 produces a serving condition discrimination signal 800Ba of the low level. Therefore, the discrimination signal 133U in the up direction of third floor assumes the low level via the AND gate 870.

In the cage call registering circuit 14BX (FIG. 8) of the elevator No. 1 corresponded to the fourth floor, therefore, the AND gate 840 continues to produce output of the low level even when the elevator No. 1 starts to open the door, the up arrival display instruction signal 356UXa of the third floor assumes the high level, and both the fourth-floor-bound destination call signal 304 and the destination button lamp turn-on instruction signal 34BL bound for the fourth floor assume the high level. Accordingly, the cage call of the fourth floor is not automatically registered for the elevator No. 1.

This also holds true even when the elevator No. 1 which is the non-allotted cage is staying on the third floor with its door open and with its up hall lantern 11UX flashing, and even when a person coming on the hall depresses a fifth-floor-bound button 5A to go to the fifth floor. In this case, the destination call bound for the fifth floor is registered (fifth-floor-bound call signal 305 assumes the high level), and the fifth-floor-bound button lamp 5B turns on (destination button lamp turn-on instruction signal 35BL bound for the fifth floor assumes the high level). However, the cage call bound for the fifth floor is not automatically registered for the elevator No. 1.

Here, if the serving condition discriminating circuit 800B produces 25 seconds of duration time signal 810*a* of up call of third floor, the comparator 812 produces a serving condition discrimination signal 800Ba of the high level. In the first-arrival cage detector circut 800A, on the other hand, the up arrival display instruction signal 356UYa of the third floor assumes the low level, and the NOT gate 883 produces output of the high level, since the elevator No. 2 which is the allotted cage is still staying on the second floor. Further, since up allotting signal 33UY of the elevator No. 2 is assuming the high level, the AND gate 849 produces output of the high level, and the first-arrival cage detection signal 800Aa in the up direction of third floor assumes the high level via the OR gate 864. Thus, the AND gate 870 produces a discrimination signal 133U of the high level in the up direction of third floor.

In this case, therefore, the output of the AND gate 840 assumes the high level, the output of the OR gate 861 assumes the high level, the content of memory 807 is set to the high level, and cage call of the fourth floor is automatically registered on the elevator No. 1 (cage call of the fifth floor is also automatically registered on the elevator No. 1 even when a person who wishes to go to the fifth floor depresses the fifth-floor-bound button 5A under the condition where the elevator No. 1 is opening the door on the third floor).

Under the condition in which the non-allotted cage has arrived earlier than the allotted cage according to the embodiment explained with reference to FIGS. 7 to 9, when it is so considered that the time in which the people are waiting for is shorter than a predetermined time and people are less likely to go on board the cage which has arrived first instead of the allotted cage, the destination call is not automatically registered as cage call for the non-allotted cage that has arrived first, like the traditional manner. Conversely, when it is so considered that the time in which the people are waiting for is longer than the predetermined time, and the people are likely to go on board the cage that has arrived first, the destination call is automatically registered as cage call even for the non-allotted cage, that has arrived first. Therefore, even when impatient people go on board the cage that has arrived first instead of the allotted cage, they are allowed to register cage call for their desired floors, and the elevator can be used more conveniently. This further eliminates such an inconvenience that cage call is uselessly registered when a person did not go on board the cage that has arrived first.

When the non-allotted cage starts to close the door (door open-close instruction signal 59X assumes the high level) after the people have went on board or have got out of the cage, the up arrival display instruction signal 356UXa of the third floor assumes the low level, and the up hall lantern 11UX of the third floor is turned off.

Figure 10:
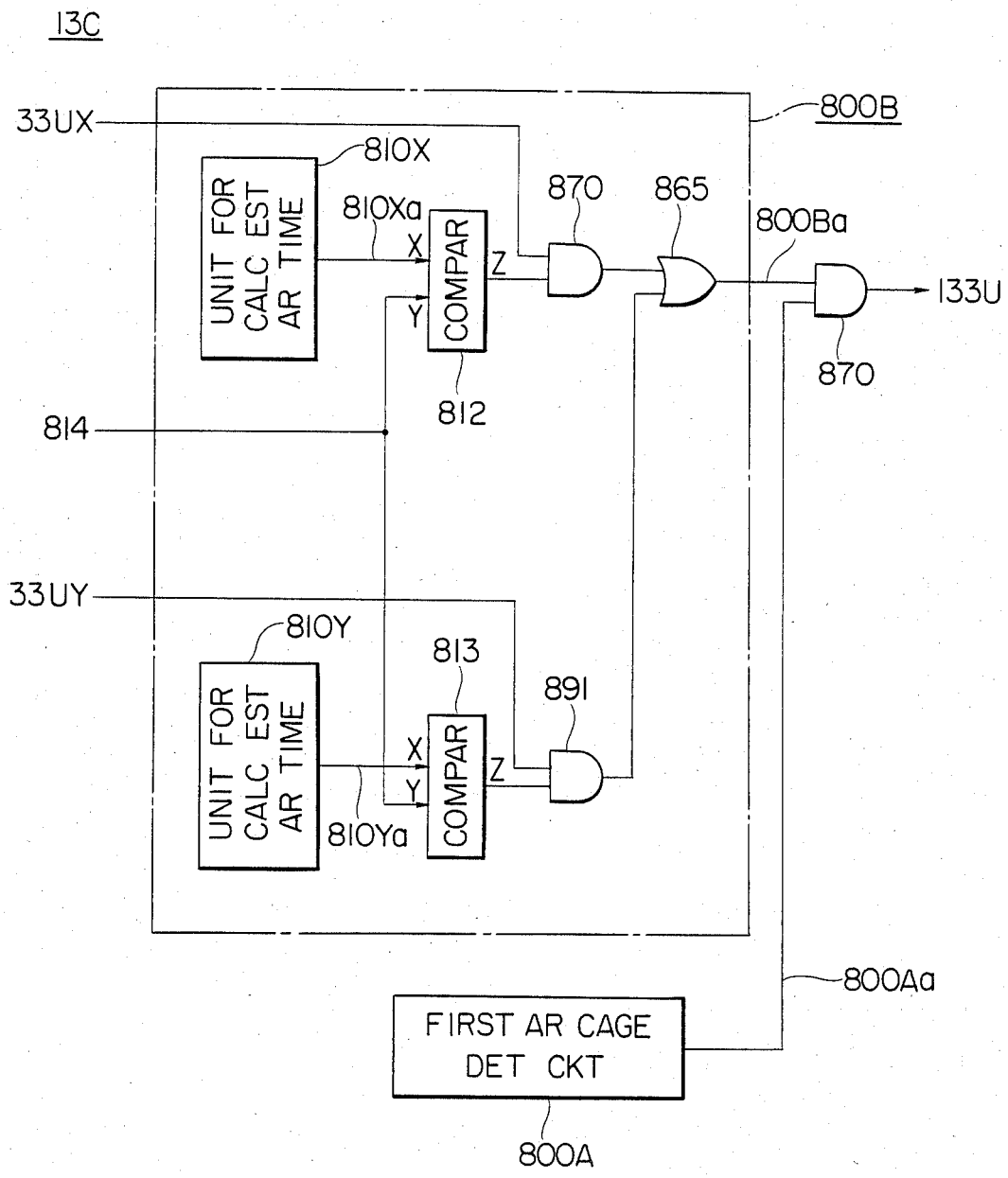
FIGS. 10 and 11 are diagrams of logic circuits for discriminating the registration of a cage that has arrived earlier according to further embodiments of the present invention.

FIG. 10 shows another embodiment of the present invention, i.e., shows a circuit which corresponds to the circuit 13C for discriminating the registration of first-arrival cage of FIG. 9.

In FIG. 10, reference numerals 810X and 810Y denote known estimated arrival time calculation units which calculate estimated times required for the elevators Nos. 1 and 2 to arrive at the third floor in the up direction from the present positions, i.e., which calculate estimated arrival times, and which produce estimated arrival time signals 810Xa, 810Ya. Reference numeral 813 denotes a comparator similar to the comparator 812, 814 denotes a constant-value signal which represents times of 10 seconds, 865 denotes an OR gate, and 890, 891 denote AND gates.

It is now presumed that the fourth-floor-bound butoon 4A of the hall operation board 10 is depressed on the third floor, destination call bound for the fourth floor and up call of the third floor are registered, and the elevator No. 2 staying on the second floor is allotted thereto.

When the estimated arrival time signal 810Ya of the elevator No. 2 represents a time of 5 seconds, the comparator 813 produces outout of the low level at the point Z. Therefore, the AND gate 891 produces output of the low level, and the AND gate 890 produces output of the low level, so that the OR gate 865 produces a serving condition discrimination signal 800Ba of the low level. Accordingly, the AND gate 870 produces up discrimination signal 133u of the third floor of the low level. Hence, even when the elevator No. 1 has arrived at the third floor in the up direction responsive to cage call of the third floor earlier than the elevator No. 2, cage call bound to the fourth floor is not automatically registered for the elevator No. 1 which is not the allotted cage.

However, when the estimated arrival time signal 810Ya of the elevator No. 2 represents a time of 15 seconds, the comparator 813 produces output of the high level at the point Z, the AND gate 891 produces output of the high level, and the serving condition discrimination signal 800Ba assumes the high level via the OR gate 865. Further, since the first-arrival cage detection signal 800Aa is assuming the high level, the up discrimination signal 133U of the third floor assumes the high level via the elevator No. 870.

Therefore, when the elevator No. 1 has arrived at the third floor in the up direction earlier than the elevator No. 2, cage call of the fourth floor is automatically registered even for the non-allotted cage.

Under the condition where the non-allotted cage has arrived earlier than the allotted cage according to the above-mentioned embodiment, when it is so estimated that the allotted cage will arrive at within a predetermined period of time and people are less likely to go on board the first-arrived cage instead of the allotted cage, the destination call is not automatically registered as cage call for the non-allotted cage that has arrived first, like the conventional manner. On the other hand, when it is estimated that the allotted cage will not reach within a predetermined period of time, and people are likely to go on board the first-arrived cage, the destination call is also automatically registered as cage call even for the non-allotted cage that has arrived first. Therefore, the elevator can be used more conveniently, and the cage call is not uselessly registered for the non-allotted cage that has arrived first.

Figure 11:
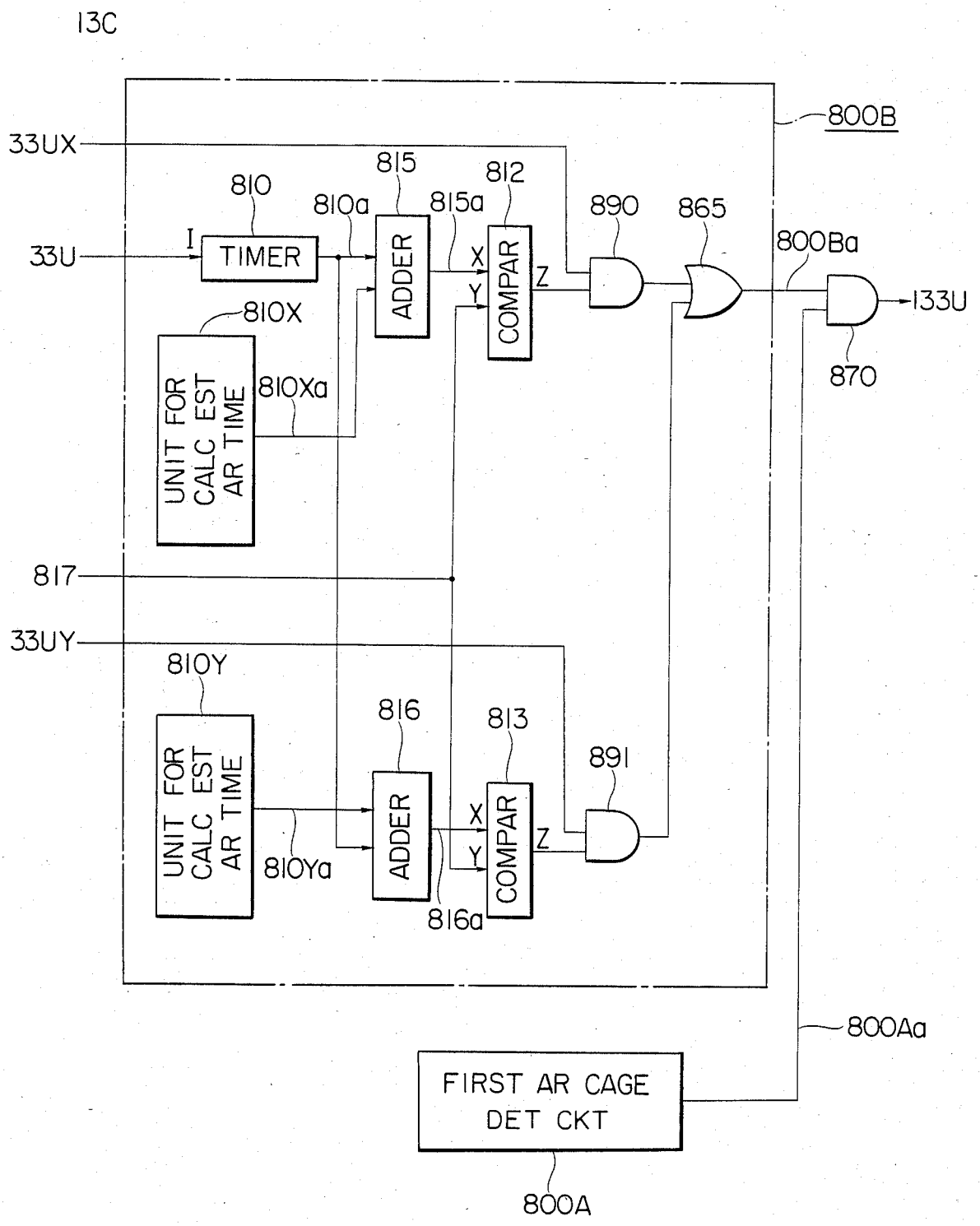

FIG. 11 shows a further embodiment according to the present invention, i.e., shows a circuit that corresponds to the circuit 13C for discriminating the registration of first-arrival cage of FIG. 9.

In FIG. 11, reference numerals 815, 816 denote adders, 815*a*, 816*a* denote outputs of the adders 815, 816, i.e., estimated waiting time signals that represent estimated waiting time until the elevators Nos. 1 and 2 respond to up call of the third floor, and 817 denotes a constant-value signal which represents a time of 20 seconds.

It is now presumed that a destination call bound for the fourth floor is registered on the third floor, the up call of the third floor is registered, and the elevator No. 2 staying on the second floor is allotted thereto.

When the estimated arrival time signal 810Ya of the elevator No. 2 which is the allotted cage represents a time of 5 seconds, and the duration time signal 810*a* of up call of the third floor represents a time of 10 seconds, the adder 816 produces the estimated waiting time signal 816*a* to be $5+10=15$ seconds. Therefore, the comparator 813 produces output of the low level, and the AND gate 891 produces output of the low level. On the other hand, since the allotting signal 33UX of the elevator No. 1 assumes the low level and output of the AND gate 890 assumes the low level, the serving condition discrimination signal 800Ba assumes the low level via the OR gate 865. Accordingly, the up discrimination signal 133U of the third floor assumes the low level via the AND gate 870. Namely, even when the elevator No. 1 has arrived at the third floor in the up direction responsive to cage call of the third floor earlier than the elevator No. 2, cage call bound for the fourth floor is not automatically registered for the elevator No. 1 that is not the allotted cage However, when the estimated arrival time signal 810Ya of the elevator No. 2 represents a time of 8 seconds, and the duration period signal 810*a* of up call of the third floor represents a time of 15 seconds, the estimated waiting time signal 816*a* becomes $8+15=23$ seconds. Therefore, the comparator 813 produces output of the high level, the allotted signal 33UY assumes the high level, the AND gate 891 produces output of the high level, and the serving condition discrimination signal 800Ba assumes the high level via the OR gate 865. Further, since the first-arrival cage detection signal 800Aa assumes the high level, the up discrimination signal 133U of the third floor assumes the high level via the AND gate 870.

Therefore, when the elevator No. 1 has arrived at the third floor in the up direction earlier than the elevator No. 2, cage call of the fourth floor is automatically registered even for the non-allotted cage.

Under the condition where the non-allotted cage has arrived earlier than the allotted cage according to this embodiment as described above, when it is estimated that waiting time until the allotted cage responds is shorter than the predetermined time and people are not likely to go on board the first-arrival cage instead of the allotted cage, the destination call is not automatically registered as cage call for the non-allotted cage that has arrived first, like in the conventional manner. On the other hand, when it is estimated that the waiting will become longer than the predetermined period of time and the people are likely to go on board the first-arrival cage, the destination call is also registered automatically as cage call even for the non-allotted cage that has arrived first. Accordingly, the elevator can be used more conveniently, and the cage call is not wastefully registered for the non-allotted cage that has arrived first.

The foregoing description has deal with the case where the fourth-floor-bound button 4A is depressed. However, the above-mentioned operation is performed even when other destination buttons 1A, 2A and 5A of the hall operation board 10 are depressed on the third floor, or even when destination buttons of hall operation boards of other floors are depressed.

In the above-mentioned embodiments, arrival information of the allotted cage and arrival information of the non-allotted cage were displayed at different times, in order to guide the people on the hall to the allotted cage, such that useless cage call is prevented from being registered. Therefore, it will be obvious that the present invention is also applicable to a system in which arrival information of the allotted cage and arrival information of the non-allotted cage are displayed at the same time.

The present invention can further be adapted to a system in whch the arrival is displayed in different forms, such as the arrival of the allotted cage is displayed by flashing the hall lantern, and the arrival of the non-allotted cage is displayed by turning the hall lantern on.

In the above-mentioned embodiments, the cage call is automatically registered irrespective of whether the people went on board the cage or not. It is, however, possible to use a photoelectric device or a weighting device under the floor of the cage to discriminate whether the people have went on board, in order to prevent useless registration of the cage call being combined with means which automatically register the cage call only when it is so detected that the people went on board the cage.

Further, the above-embodiments have illustrated the system which informs the allotted cage (system in which cage call is automatically registered necessarily for the allotted cage). However, the invention is in no way limited to the above group-controlled system only. For instance, the invention can be adapted to a system which does not inform the allotted cage in advance but which simply informs the arrivals only, and to a system which informs the position and direction of the cage using lamps or the like. In addition to the allotting system, the present invention can further be adapted to a system in which the cages that pass by respond successively to the platform calls (up call, down call, hall destination call). The invention can further be adapted to a system in which the most suitable cage is allotted for each destination call or for each group, and the cage allotted for each of the destination calls is informed by a display unit of a destination floor. In this case, the cage call can be automatically registered kindly for the people who are standing at positions from where they are inhibited from looking at their destination floors on the destination floor display unit.

Further, the present invention can be adapted to a system in which up buttons and down buttons only are provided on the hall, and the cage call of a predetermined floor is automatically registered when a hall button is depressed.

In the above embodiments, furthermore, each hall is provided with destination buttons for each of the destination floors. Means for destinating the destination floors on the hall, however, needs not be limited thereto. For instance, the invention can be adapted even for a dial system or a key board system.

The destination call is extinguished when the door is completely closed. However, once the destination call is registered for a predetermined elevator as cage call, it then needs be cancelled before the elevator starts to move. Further, the destination call may be registered as cage call at any time during a period in which the destination call is being registered.

The above embodiments have dealt with group-controlled elevators based upon the allotting system. The invention, however, should in no way be limited thereto only. For instance, desired objects can be accomplished by adapting the present invention to an elevator of the operation system in which it is expected that a multiplicity of cages running in the same direction may stop simultanuously at the same floor.

When a person comes to the hall and newly depresses a destination button under the condition where two cages heading in the same direction are staying on the same floor, and when one of the cages is just closing the door, the cage call is automatically registered therefor to open the door.

In the above-mentioned embodiments, furthermore, a serving condition value representing the serving condition of the platform is found by calculating duration period, expected arrival time of the allotted cage, and expected waiting time for the allotted cage, and the destination call is automatically registered as cage call even for the non-allotted cage that has arrived first when the serving condition value becomes poorer than a reference value. However, the serving condition value representing the serving condition of the platform needs not be limited thereto. The serving condition of the hall may be roughly discriminated relying upon the floor where the allotted cage is located, direction of running, and the number of calls allotted thereto. Further, as the cage is filled with people, other people may be left on the hall, or the allotted cage may pass through the floor without picking up the people due to automatic pass operation that works when the cage is filled with people. Depending upon the number of people, therefore, it is so discriminated that the people are placed under poorly served condition. After a cage has been newly allotted, if there is any cage that has arrived earlier than the allotted cage, the cage call can also be automatically registered for the cage that has arrived first.

Moreover, the reference value can be easily changed depending upon the number of people waiting on the hall.

Instead of detecting the serving condition of the hall, furthermore, the destination call may be registered as cage call at all times for the non-allotted cage that has arrived earlier than the allotted cage (in the circuit 13C for destinating the registration of first-arrival cage of FIG. 9, the first-arrival cage detection signal 800Aa should be produced as an up discrimination signal 133U of the third floor).

What is claimed is:

1. In an apparatus for registering elevator calls including a hall operation board provided for each of a plurality of platforms where a plurality of cages are placed in service, hall call registering means for registering a call for calling a cage to a given floor and a destination call for designating a designating a destination floor from the given floor by manipulating the hall operation board, any one of said cages being allotted to be put into service responsive to said calls, and a cage call registering means for registering a cage call corresponding to a destination call for an allotted cage, the improvement comprising an auxiliary cage call registration instruction means which, when a non-allotted cage arrives at a floor, instructs a cage call corresponding to a destination call to be also registered for said non-allotted cage.

2. An apparatus for registering elevator calls as set forth in claim 1, wherein provision is further made of a cancelling means which, when a cage call corresponding to a destination call is registered for an allotted cage, cancels the destination call simultaneously with the the registration thereof or being lagged behind the registration thereof.

3. An apparatus for registering elevator calls as set forth in claim 2, wherein a cage call is registered for the allotted cage after the door of said cage has been fully opened, the destination call is cancelled after the door of said cage has been completely closed, and said auxiliary cage call registration instruction means instructs a cage call to be registered after the door of the non-allotted cage has been fully opened but before the destination call is cancelled.

4. An apparatus for registering elevator calls as set forth in claim 2, wherein said hall call registering means has a first memory means which stores a call for calling cage and a second memory means which stores a destination call for designating a destination floor, depending upon the manipulation of said platform operation board, and wherein said first and second memory means eliminate the stored contents upon receipt of a signal from said cancelling means.

5. An apparatus for registering elevator calls as set forth in claim 4 wherein said first and second memory means are provided for each of the destination floors and for each of the directions of elevator operation.

6. An apparatus for registering elevator calls as set forth in claim 4, wherein when said second memory means stores a destination call, said hall call registering means works to turn on a designated lamp among a plurality of destination lamps that are provided on said hall operation board and that correspond to the destination floors, and said cancelling means produces an output to turn said destination lamp off.

7. An apparatus for registering elevator calls as set forth in claim 6, wherein said cancelling means produces signals to turn off all of the destination lamps corresponding to the floors in the running direction subsequent to the floor where a call for calling a cage is registered.

8. An apparatus for registering elevator calls as set forth in claim 2, wherein when a cage call corresponding to a destination call is registered for a non-allotted cage, said cancelling means does not produce a signal to cancel the content registered by said hall call registering means.

9. An apparatus for registering elevator calls as set forth in claim 1, wherein when a cage has arrived first at a floor where said hall board is manipulated and when another cage has arrived at the same floor being lagged behind, said auxiliary cage call registration instruction means instructs to register a destination call designated by said operation board for said cage that has arrived first but does not instruct to register said destination call for a cage that has arrived being lagged behind.

10. An apparatus for registering elevator calls as set forth in claim 9, wherein a hall lantern provided on the hall does not inform in advance the arrival of a cage that will arrive being lagged behind, but displays the arrival after the cage has arrived.

11. An apparatus for registering elevator calls as set forth in claim 1, wherein provision is further made of an operation control circuit which detects operation directions of each of the cages to produce direction signals, and which also produces stop signals when the cages are stopped, and cage call registering circuits which are provided for each of the cages to register a cage call, and wherein when a plurality of cages operating in the same direction are producing stop signals staying at the same floor, signals produced responsive to destination calls are sent to cage call registering circuits of said plurality of cages thereby to register cage calls.

12. An apparatus for registering elevator calls as set forth in claim 1, wherein provision is further made of a first-arrival cage detector means which operates when any cage has arrived at a hall before an allotted cage arrives at a hall, and when said first-arrival cage detector means operates, said auxiliary cage call registration instruction means produces an instruction to register a cage call corresponding to said destination call for said cage that has arrived first.

13. An apparatus for registering elevator calls as set forth in claim 1, wherein when the hall operation board of a given floor is manipulated to register a destination call while a cage is staying on said floor, said auxiliary cage call registration instruction means produces an instruction to register the destination call for said cage that is staying.

14. An apparatus for registering elevator calls as set forth in claim 1, wherein provision is further made of a serving condition calculating means which calculates a serving condition value that represents serving condition of said hall, a serving condition discriminating means which operates when said serving condition value is poorer than a reference value, a first-arrival cage detecting means which operates when any cage has arrived first at said hall before said allotted cage arrives at said hall, and a first-arrival cage registration permitting means which operates when both said serving condition discriminating means and said first-arrival cage detecting means operate, and wherein when said first-arrival cage registration permitting means operates, said auxiliary cage call registration instruction means produces an instruction to register a cage call corresponding to said destination call for said cage that has arrived first.

15. An apparatus for registering elevator calls as set forth in claim 14, wherein the serving condition value is based upon a duration period of hall call, and said serving condition discriminating means operates when said duration period is longer than a reference value.

16. An apparatus for registering elevator calls as set forth in claim 14, wherein the serving condition value is based upon an estimated arrival time in which the allotted cage will arrive at the hall, and said serving condition discriminating means operates when said estimated arrival time is longer than a reference value.

17. An apparatus for registering elevator calls as set forth in claim 14, wherein the serving condition value is based upon an estimated waiting time of the hall for the allotted cage, and said serving condition discriminating means operates when said estimated waiting time is longer than a reference value.

18. In an apparatus for registering elevator calls including a hall operation board provided for halls where a plurality of cages are placed in service, means by which a call for calling a cage and a destination call for designating a destination floor are registered by the hall operation board, a first cage which has detected these calls first is placed in service for said destination floor, a cage call corresponding to said destination call is registered for said first cage, and said destination call is cancelled simultaneously with the registration of the cage call or being lagged behind the registration thereof, the improvement comprising an auxiliary cage call registration instruction means which instructs a cage call corresponding to a destination call to be also registered for a second cage that has arrived at said floor delayed behind said first cage.

* * * * *